US005717824A

United States Patent [19]

Chhatwal

[11] Patent Number: 5,717,824

[45] Date of Patent: Feb. 10, 1998

[54] ADAPTIVE SPEECH CODER HAVING CODE EXCITED LINEAR PREDICTOR WITH MULTIPLE CODEBOOK SEARCHES

[75] Inventor: Harprit S. Chhatwal, Heston, United Kingdom

[73] Assignee: Pacific Communication Sciences, Inc., San Diego, Calif.

[21] Appl. No.: 163,089

[22] Filed: Dec. 7, 1993

Related U.S. Application Data

[63] Continuation-in-part of Ser. No. 927,137, Aug. 7, 1992, Pat. No. 5,457,783.

[51] Int. Cl.[6] ..... G10L 3/02

[52] U.S. Cl. ..... 395/2.31; 395/2.29; 395/2.28

[58] Field of Search ..... 395/2, 2.29, 2.31, 395/2.4, 2.6, 2.32, 2.28, 2.09

[56] References Cited

U.S. PATENT DOCUMENTS

| | | | |
|---|---|---|---|
| 4,958,225 | 9/1990 | Bi et al. | 358/133 |
| 5,031,037 | 7/1991 | Israelsen | 358/133 |
| 5,179,594 | 1/1993 | Yip et al. | 381/40 |
| 5,187,745 | 2/1993 | Yip et al. | 381/36 |
| 5,195,137 | 3/1993 | Swaminathan | 381/32 |
| 5,265,190 | 11/1993 | Yip et al. | 395/2.28 |
| 5,327,519 | 7/1994 | Haggvist et al. | 395/2.28 |
| 5,353,352 | 10/1994 | Dent et al. | 380/37 |
| 5,371,853 | 12/1994 | Kao et al. | 395/2.32 |

OTHER PUBLICATIONS

High Temporal Resolution in Multi–Pulse Coding Bergström, IEEE May 89.

*Primary Examiner*—Allen R. MacDonald
*Assistant Examiner*—Richemond Dorvil
*Attorney, Agent, or Firm*—John P. Donohue, Jr.; Merle W. Richman, III; J. P. Violette

[57] ABSTRACT

Methods and apparatus determining codevectors in response to a speech signal include a first codebook member which stochastically determines the characteristics of a bi-pulse codevector representative of a target vector associated with the speech signal and for removing the bi-pulse codevector from the target vector thereby forming an intermediate target vector. A second codebook member stochastically determines the characteristics of a second bi-pulse codevector in response to the intermediate target vector. In one embodiment of the invention a third codebook member adaptively determines a first codeword in response to the target signal and forms another intermediate target signal and a fourth codebook member stochastically determines a second codeword in response to the intermediate target signal. Synthesized speech signals are determined from the first and second codevectors and from the first and second codewords formed from either the first and second codebook pairing or from the third and fourth codebook pairing. A comparator determines and chooses the synthesized speech signal having the least difference with the speech signal. The codewords or codevectors associated with the chosen synthesized speech signal are selected for transmission. In most cases, the speech signal is divided into frames and each frame is divided into subframes. In such situations, codebook searches may be determined for each subframe. In a further embodiment, an additional codebook search, a single pulse codebook search, is performed over a plurality of subframes, preferably two. In another embodiment, remainder signal are formed by removing the codewords and codevectors from the speech signal. In such an embodiment, a weighting filter is provided for weighting predetermined portions of the remainder signals prior to determining which remainder signal is representative of the synthesized speech signal having the least difference with the original speech signal.

21 Claims, 8 Drawing Sheets

ADAPTIVE SPEECH CODER HAVING CODE EXCITED LINEAR PREDICTOR WITH MULTIPLE CODEBOOK SEARCHES

RELATED APPLICATIONS

This application is a continuation-in-part of application Ser. No. 07,927,137 filed on Aug. 7, 1992, now U.S. Pat. No. 5,457,783, which is assigned to the same assignee as the present application and is incorporated herein by reference.

FIELD OF THE INVENTION

The present invention relates to the field of speech coding, and more particularly, to improvements in the field of adaptive coding of speech or voice signals wherein code excited linear prediction (CELP) techniques are utilized.

BACKGROUND OF THE INVENTION

Digital telecommunication carrier systems have existed in the United States since approximately 1962 when the T1 system was introduced. This system utilized a 24-voice channel digital signal transmitted at an overall rate of 1.544 Mb/s. In view of cost advantages over existing analog systems, the T1 system became widely deployed. An individual voice channel in the T1 system was typically generated by band limiting a voice signal in a frequency range from about 300 to 3400 Hz, sampling the limited signal at a rate of 8 Khz, and thereafter encoding the sampled signal with an 8 bit logarithmic quantizer. The resultant digital voice signal was a 64 kb/s signal. In the T1 system, 24 individual digital voice signals were multiplexed into a single data stream.

Because the overall data transmission rate is fixed at 1.544 Mb/s, the T1 system is limited to 24 voice channels if 64 kb/s voice signals are used. In order to increase the number of voice signals or channels and still maintain a system transmission rate of approximately 1.544 Mb/s, the individual signal transmission rate must be reduced from 64 kb/s to some lower rate. The problem with lowering the transmission rate in the typical T1 voice signal generation scheme, by either reducing the sampling rate or reducing the size of the quantizer, is that certain portions of the voice signal essential for accurate reproduction of the original speech is lost. Several alternative methods have been proposed for converting an analog speech signal into a digital voice signal for transmission at lower bit rates, for example, transform coding (TC), adaptive transform coding (ATC), linear prediction coding (LPC) and code excited linear prediction (CELP) coding. For ATC it is estimated that bit rates as low as 12–16 kb/s are possible. For CELP coding it is estimated that bit rates as low as 4.8 kb/s are possible.

In virtually all speech signal coding techniques, a speech signal is divided into sequential blocks of speech samples. In TC and ATC, the speech samples in each block are arranged in a vector and transformed from the time domain to an alternate domain, such as the frequency domain. In LPC and CELP coding, each block of speech samples is analyzed in order to determine the linear prediction coefficients for that block and other information such as long term predictors (LTP). Linear prediction coefficients are equation components which reflect certain aspects of the spectral envelope associated with a particular block of speech signal samples. Such spectral information represents the dynamic properties of speech, namely formants.

Speech is produced by generating an excitation signal which is either periodic (voiced sounds), aperiodic (unvoiced sounds), or a mixture (eg. voiced fricatives). The periodic component of the excitation signal is known as the pitch. During speech, the excitation signal is filtered by a vocal tract filter, determined by the position of the mouth, jaw, lips, nasal cavity, etc. This filter has resonances or formants which determine the nature of the sound being heard. The vocal tract filter provides an envelope to the excitation signal. Since this envelope contains the filter formants, it is known as the formant or spectral envelope. It is this spectral envelope which is reflected in the linear prediction coefficients.

Long Term Predictors are filters reflective of redundant pitch structure in the speech signal. Such structure is removed by using the LTP to estimate signal values for each block and subtracting those values from actual current signal values. The removal of such information permits the speech signal to be converted to a digital signal using fewer bits. The LTP values are transmitted separately and added back to the remaining speech signal at the receiver. In order to understand how a speech signal is reduced and converted to digital form using LPC techniques, consider the generation of a synthesized or reproduced speech signal by an LPC vocoder.

Known LPC vocoders operate to convert transmitted digital signals into synthesized voice signals, i.e., blocks of synthesized speech samples. Basically, a synthesis filter, utilizing the LPCs determined for a given block of samples, produces a synthesized speech output by filtering an excitation signal in relation to the LPCs. Both the synthesis filter coefficients (LPCs) and the excitation signal are updated for each sample block or frame (i.e. every 20–30 milliseconds). It is noted that, the excitation signal can be either a periodic excitation signal or a noise-like excitation signal.

It will be appreciated that synthesized speech produced by an LPC vocoder can be broken down into three basic elements:

(1) The spectral information which, for instance, differentiates one vowel sound from another and is accounted for by the LPCs in the synthesis filter;

(2) For voiced sounds (e.g. vowels and sounds like z, r, l, w, v, n), the speech signal has a definite pitch period (or periodicity) and this is accounted for by the periodic excitation signal which is composed largely of pulses spaced at the pitch period (determined from the LTP);

(3) For unvoiced sounds (e.g., t, p, s, f, h), the speech signal is much more like random noise and has no periodicity and this is provided for by the noise excitation signal.

LPC vocoders can be viewed as including a switch for controlling the particular form of excitation signal fed to the synthesis filter. The actual volume level of the output speech can be viewed as being controlled by the gain provided to the excitation signal. While both types of excitation (2) and (3), described above, are very different in the time domain (one being made up of equally spaced pulses while the other is noise-like), both have the common property of a flat spectrum in the frequency domain. The correct spectral shape will be provided in the synthesis filter by the LPCs.

It is noted that use of an LPC vocoder requires the transmission of the LPCs, the excitation information and whether the switch is to provide periodic or noise-like excitation to the speech synthesizer. Consequently, a reduced bit rate can be used to transmit speech signals processed in an LPC vocoder.

There are, however, several flaws in the generalized LPC vocoder approach which effect the quality of speech reproduction, i.e. the speech heard in a telephone handset.

One flaw is the need to choose between pulse-like or noise-like excitation, which decision is made every frame based on the characteristics of the input speech at that moment. For semi-voiced speech (or speech in the presence of a lot of background noise), such frame by frame choosing can lead to a lot of flip-flopping between the two types of excitation signals, seriously degrading voice quality.

CELP vocoders overcome this problem by leaving ON both the periodic and noise-like signals at the same time. The degree to which each of these signals makes up the excitation signal (e(n)) for provision to the synthesis filter is determined by separate gains which are assigned to each of the two excitations. Thus, $$e(n)=\beta\cdot p(n)+g\cdot c(n) \quad (1)$$

where p(n)=pulse-like periodic component c(n)=noise-like component

β=gain for periodic component g=gain for noise component

If g=0, the excitation signal will be totally pulse-like while if β=0, the excitation signal is totally noise-like. The excitation will be a mixture of the two if the gains are both non-zero.

One other difference is noted between CELP and simple LPC vocoders. During a coding operation in an LPC vocoder, the input speech is analyzed on a frame-by-frame, step-by-step manner to determine what the most likely value is for the pitch period of the input speech. In LPC vocoders the decision about the best pitch period is final for that frame. No comparison is made between possible pitch periods to determine an optimum pitch period.

In a CELP vocoder, the approach to the periodic excitation component or pitch is much more rigorous. Out of a set of possible pitch periods for each frame (which covers the range of possible pitch for all speakers be they male, female or children), every single possible value is tried in turn and speech is synthesized assuming this value. The error between the actual speech and the synthesized speech is calculated and the pitch period that gives the minimum error is chosen. This decision procedure is a closed-loop approach because an error is calculated for each choice and is fed back to the decision part of the process which chooses the optimal pitch value. Again, traditional LPC vocoders use an open-loop approach where the error is not explicitly calculated and there is no decision as to which pitch period to choose from a set of possibilities.

The noise component of the excitation signal in a CELP vocoder is selected using a similar approach to choosing pitch period. The CELP vocoder has stored within it several hundred (or possibly several thousand) noise-like signals each of which is one frame long. The CELP vocoder uses each of these noise-like signals, in turn, to synthesize output speech for a given frame and chooses the one which produces the minimum error between the input and synthesized speech signals, another closed-loop procedure. This stored set of noise-like signals is known as a codebook and the process of searching through each of the codebook signals to find the best one is known as a codebook search. The major advantage of the closed-loop CELP approach is that, at the end of the search, the best possible values have been chosen for a given input speech signal—leading to major improvements in speech quality.

It is noted that use of CELP coding techniques requires the transmission of only the LPC values, LTP values and the address of the chosen codebook signal for each frame. It is not necessary to transmit a digital representation of an excitation signal. Consequently, CELP coding techniques have the potential of permitting transmission of a frame of speech information using fewer bits and are therefore particularly desirable to increase the number of voice channels in the T1 system. It is believed that the CELP coding technique can reach transmission rates as low as 4.8 kb/s.

The primary disadvantage with current CELP coding techniques is the amount of computing power required. In CELP coding it is necessary to search a large set of possible pitch values and codebook entries. The high complexity of the traditional CELP approach is only incurred at the transmitter since the receiver consists of just a simple synthesis structure including components for summing the periodic and excitation signals and a synthesis filter. One aspect of the present invention overcomes the need to perform traditional codebook searching. In order to understand the significance of such an improvement, it is helpful to review the traditional CELP coding techniques.

It will be appreciated from the above description that in a traditional CELP coder, synthesized speech is formed by passing the output of two (2) particular codebooks through an LPC synthesis filter. The first codebook is known as an adaptive codebook, while the second codebook is known as a stochastic codebook. The adaptive codebook is responsible for modeling the pitch or periodic speech components, i.e. those components based on voiced sounds such as vowels, etc. which have a definite pitch. LTP components are selected from this codebook. The stochastic codebook generates random noise-like speech and models those signals which are unvoiced.

The general CELP speech signal conversion operation is shown in FIGS. 1*a* and 1*b*. As shown, the order of conversion processes for transmission is generally as follows: (i) compute LPC coefficients, (ii) use LPC coefficients in determining LTP parameters (i.e. best pitch period and corresponding gain β) in an adaptive codebook search, (iii) use LPC coefficients and the winning adaptive codebook vector in a stochastic codebook search to determine the best codeword c(n) and corresponding gain g. In the present invention, it is the final two steps which have been improved.

More particularly, CELP speech signal conversion is performed on a frame by frame basis. As indicated above, each frame includes a number of speech samples from one to several hundred. Referring to FIG. 1, every 40–60 speech samples are buffered together at 10 to form a "subframe" of the speech input. The samples in each subframe are analyzed at 12 to determine the spectral information (LPC information) and filtered by a Perceptual Weighting Filter (PWF) 14 to form an "adaptive" target vector. The "adaptive" target vector is formed by subtracting the LPC information from the speech input. The "adaptive" target vector, in turn, is used as the input to the adaptive codebook search 16 which searches through a whole sequence of possible codevectors within the codebook to find the one which best matches the "adaptive" target vector.

The effect of the winning codevector is removed from the "adaptive" target vector by forming the winning codevector at 18 and subtracting it from the adaptive target vector to form a "stochastic" target vector for the stochastic codebook search at 22. Information identifying or describing the winning codevectors from the adaptive and stochastic codebooks, typically memory addresses, are then formatted together with the LPC parameters at 24 and provided to transmit buffer 26 for transmission. The whole process is then repeated in the next subframe and so on. In general, 3–5 subframes together form a speech frame which forms the basis of the transmission process, i.e. coded speech parameters are transmitted from the speech encoder to the speech decoder every frame and not every subframe.

As shown in FIG. 1*b*, transmitted information is received in receive buffer 28, and deformatted at 30. Information relating to the winning codevectors are used to reproduce the adaptive and stochastic codevectors at 32 and 34, respectively. The adaptive and stochastic codevectors are then added together at 36 and passed through the LPC synthesis filter 38, having received the LPC values from deformater 30, to provide synthesized speech to output buffer 40.

It is noted that the codebook search strategy for the above described stochastic codebook consists of taking each codebook vector (c(n)) in turn, passing it through the synthesis filter, comparing the output signal with the input speech signal and minimizing the error. In order to perform such a search strategy, certain preprocessing steps are required.

At the start of any particular frame, the excitation components associated with the adaptive codebook, i.e., the LTP (p(n)), and the stochastic codebook (c(n)) are still to be computed. However even if both of these signals were to be completely zero for the whole frame, the synthesis filter nonetheless has some memory associated with it, thereby producing an output for the current frame even with no input. This frame of output due to the synthesis filter memory is known as the ringing vector r(n). In mathematical terms, this ringing vector can be represented by the following filtering operation:

$$r(n)=\sum_{i=1}^{p}\alpha_i r(n-i) \tag{2}$$

where $\{\alpha_i$ for i=1 to p$\}$ is the set of LPC coefficients. We now have the component of the output synthesized speech signal (s'(n)) which would be generated even if the excitation signal (e(n)) were zero. However, passing e(n) through the LPC synthesis filter gives a signal y(n) which can be represented as follows:

$$y(n)=e(n)+\sum_{i=1}^{p}\alpha_i y(n-i) \tag{3}$$

and thus, this e(n) based signal together with the ringing vector produce the synthesized speech signal s'(n):

$$s'(n)=r(n)+y(n) \tag{4}$$

It will be appreciated that the above equations or digital filtering expressions are somewhat cumbersome. In CELP coding it is desirable for the various processing operations to be described in matrix form. Consider first the synthesis filter. The impulse response of a filter is defined by the output obtained from an input signal having a pulse of value +1 at time zero. Now, if the LPC synthesis filter has an impulse response a(n) (where n represents the speech samples in the range 0 to (N−1) and N is the length of the frame or block), one can construct an (N-by-N) matrix representative of the impulse response of the LPC synthesis filter as follows:

$$A=\begin{bmatrix} a_0 & a_1 & a_2 & \cdot & \cdot & \cdot & a_{n-1} \\ 0 & a_0 & a_1 & \cdot & \cdot & \cdot & a_{n-2} \\ 0 & 0 & a_0 & \cdot & \cdot & \cdot & a_{n-3} \\ \cdot & \cdot & \cdot & \cdot & & & \cdot \\ \cdot & \cdot & \cdot & & \cdot & & \cdot \\ \cdot & \cdot & \cdot & & & \cdot & \cdot \\ 0 & 0 & 0 & \cdot & \cdot & \cdot & a_0 \end{bmatrix} \tag{5}$$

The codebook signal c(n) can be represented in matrix form by an (N-by-1) vector c. This vector will have exactly the same elements as c(n) except in matrix form. The operation of filtering c by the impulse response of the LPC synthesis filter A can be represented by the matrix multiple Ac. This multiple produces the same result as the signal y(n) in equation (3) for β equal to zero.

The synthesized output speech vector s' can be represented in matrix form as:

$$s'=r+Ae$$

where r and e are the (N-by-1) vector representations of the signals r(n), e(n) (the ringing signal and the excitation signal) respectively. The result is the same as equation (4) but now in matrix form. From equation (1), the synthesized speech signal can be rewritten in matrix form as:

$$\begin{aligned} s' &= r+A(\beta\cdot p+g\cdot c) \\ &= r+\beta Ap+gAc \end{aligned} \tag{6}$$

Since s' is an approximation to the actual input speech vector s (i.e. s'≅s), equation (6) can be rearranged as:

$$gAc\cong s-r-\beta Ap \tag{7}$$

A typical prior art codebook search implements equations 5, 6 and 7 above. First, the input speech signal has the ringing vector r removed. Next, the LTP vector p (i.e. the pitch or periodic component p(n) of the excitation) is filtered by the LPC synthesis filter, represented by Ap, and then subtracted off. The resulting signal is the so-called target vector x which is approximated by the term gAc.

During the actual codebook search, there are two important variables ($C_i$,$G_i$) which must be computed. These are given in matrix terms as:

$$\begin{aligned} C_i &= c^tA^tx \\ G_i &= c^tA^tAc \end{aligned} \tag{8}$$

where $A^t$ is the transpose of the impulse response matrix A of the LPC synthesis filter. Solving equation (8), reveals that both $C_i$, $G_i$ are scaler values (i.e. single numbers, not vectors). These two numbers are important as they together determine which is the best codevector and also the best gain g.

As mentioned before, the codebook is populated by many hundreds of possible vectors c. Consequently, it is desirable not to form Ac or $c^tA^t$ for each possible codebook vector. This result is achieved by precomputing two variables before the codebook search, the (N-by-1) vector d and the (N-by-N) matrix F such that:

$$d=A^tx$$

&

$$F=A^tA \tag{9}$$

where x is the target vector and A is impulse response matrix of the LPC synthesis filter. The process of pre-forming d is known as "backward filtering". As a result of such backward filtering, during the codebook search, only the following operations need be performed:

$$C_i = c^t d$$

$$G_i = c^t F c \tag{10}$$

Traditionally, the selected codebook vector is that vector associated with the largest value for:

$$\hat{E} = \frac{C_i^2}{G_i}$$

The correct gain g for a given codebook vector is given by:

$$\frac{C_i}{G_i}$$

Unfortunately, even this simplified codebook search can require either excessive amounts of time or excessive amounts of processing power.

An example of a CELP vocoder is shown in U.S. Pat. No. 4,817,157—Gerson. There is described an excitation vector generation and search technique for a speech coder using a codebook having excitation code vectors. A set of basis vectors are said to be used along with the excitation signal codewords to generate the codebook of excitation vectors. The codebook is searched using knowledge of how the codevectors are generated from the basis vector. It is claimed that a reduction in complexity of approximately 10 times results from practicing the techniques of this patent. However, the technique still requires the storage of codebook vectors. In addition, the codebook search involves the following steps for each vector: scaling the vector; filtering the vector by long term predictor components to add pitch information to the vector; filtering the vector by short term predictors to add spectral information; subtracting the scaled and double filtered vector from the original speech signal and analyzing the answer to determine whether the best codebook vector has been chosen.

A need existed for a CELP coder which was capable of quickly searching the codebook for the proper codebook vector c, without requiring relatively significant computing power. The invention described in the above identified related application met that need. However, for unvoiced sounds, that approach still had drawbacks. Accordingly, a need still exists for a CELP coder capable of quickly searching a codebook for the proper codebook vector c and which accurately codes unvoiced sounds.

SUMMARY OF THE INVENTION

The problems of the prior art are overcome and the advantages of the invention are achieved in apparatus and methods for determining codevectors in a speech coder which codes a speech signal for digital transmission. In such methods and apparatus a target vector is provided. A first codebook member determines the characteristics of a bi-pulse codevector representative of the target vector and removes the bi-pulse codevector from the target vector thereby forming an intermediate target vector. A second codebook member determines the characteristics of a second bi-pulse codevector in response to the intermediate target vector.

The first codebook member includes a first stochastic codebook member for determining a first stochastic codeword in relation to the target signal. The second codebook member includes a second stochastic codebook member for determining a second stochastic codeword in response to the intermediate vector. It is preferred for the first and second codebook members to each perform a scrambled Hadamard codebook search to determine a scrambled Hadamard codeword and to perform a bi-pulse codebook search to determine the characteristics of a bi-pulse codeword.

The speech coder can also include a third codebook member to adaptively determine a first adaptive codeword in response to the target signal and for removing the adaptive codeword from the target signal thereby forming an intermediate target signal. In such an embodiment, a fourth codebook member is provided for stochastically determining a second codeword in response to the intermediate target signal. The third codebook member determines long term predictor information in relation to the target vector.

In the embodiment including an adaptive-stochastic codebook search combination, a first synthesized speech signal can be determined from the first and second codevectors and a second synthesized speech signal can be determined from the first and second codewords. In such a situation it is preferred to provide an error calculation member for calculating the error associated with the first and second synthesized speech signals and a comparator for comparing the error associated with the synthesized speech signals and for selecting that synthesized speech signal having the lowest error. In such an embodiment, it is also desirable to include a scaling member for scaling the error associated with the first speech signal prior to comparison by the comparator.

Another form of speech coder for overcoming the problems of the past includes a first search member for performing an adaptive codebook search and a first stochastic codebook search for each frames of digital samples in a speech signal and for forming an adaptive codevector and a first stochastic codevector. A second search member is also included for performing second and third stochastic codebook searches for each frame and for forming a second stochastic codevector and a third stochastic codevector in the second and third stochastic search. An error member is provided for computing a first difference value between synthesized speech signal resulting from the adaptive and first stochastic codevectors and the original speech signal and for determining a second difference value between the synthesized speech signal resulting from the second and third stochastic codevectors and the original speech signal. A comparator is also provided for comparing the first and second difference values to determine which is less and for choosing the codevectors associated with the difference value determined to be lowest.

In such a speech coder, each frame may be divided into a plurality of subframes. In such a situation, the first and second search means determine the adaptive, first, second and third stochastic codewords for each subframe. The comparator then determines which of the first and second difference values is lowest for each subframe. It is preferred, in such an embodiment, for the comparator to determine which of the first and second difference values is lowest for a plurality of the subframes. Multiple subframe determinations are achieved by the error member including an accumulator for accumulating the first and second difference values over a plurality of frames. In such an embodiment, the accumulator includes a first adder for adding a plurality of the first difference values and a second adder for adding a plurality of the second difference values. It is especially preferred for the accumulator to accumulate the first and second error values over two subframes.

In the multiple subframe speech coder a scaling member is provided for scaling the value associated with the second difference value accumulated by the accumulator.

Still further in the multiple subframe speech coder, a removal member can be provided for removing either the adaptive and first stochastic codewords or the second and third stochastic codewords from the original speech signal thereby forming a third remainder target signal depending on whether the first or second difference values are chosen by the comparator. In such an embodiment, a third search member is provided for performing a codebook search on the third remainder target signal. It is preferred for the third search member to perform a stochastic codebook search over two remainder target signals associated with two subframes by performing a single pulse codebook search.

In a still further embodiment, the speech coder includes a first search member which removes the adaptive and first stochastic codevectors from the corresponding portion of the speech signal thereby forming a first remainder signal and includes a second search member which removes the second and third stochastic codevectors from the corresponding portion of the speech signal, thereby forming a second remainder signal. In such a speech coder a weighting filter is interposed between the first and second search members and the error member for weighting predetermined portions of the first and second remainder signals prior to the determination of the first and second difference values. In such an embodiment, weighting filter weights the frequencies of the remainder signal greater than 3,400 Hz. It is also preferred in this embodiment to include a high pass filter interposed between the first and second codebook search members and the weighting filter.

BRIEF DESCRIPTION OF THE DRAWINGS

These and other objects and advantages of the invention will become more apparent from the following detailed description when taken in conjunction with the following drawings, in which:

FIG. 1(*b*) is a block diagram of the receiving portion of a prior art generalized CELP vocoder-transmitter;

FIG. 5(*b*) is a flow chart of those operations performed in the adaptive coder shown in FIG. 2, prior to transmission, wherein a multiple codebook analysis is performed over multiple subframes;

FIG. 7(*b*) is a block diagram of a preferred embodiment of a perceptual weighting filter implemented in the adaptive transform coder shown in FIG. 2.

DETAILED DESCRIPTION OF THE PREFERRED EMBODIMENT

As will be more completely described with regard to the figures, the present invention is embodied in a new and novel apparatus and method for adaptive speech coding wherein bit rates have been significantly reduced to approximately 4.8 kb/s. Generally, the present invention enhances CELP coding for reduced transmission rates by providing more efficient methods for performing a codebook search and for providing codebook information from which the original speech signal can be more accurately reproduced.

To this end, the present invention determines when it would be more appropriate to dispense with the adaptive codebook (LTP determinations) altogether and instead use the bits freed up by foregoing the LTP to add another codevector obtained from a second stochastic codebook to the modeling process. In this way, voiced speech would still be characterized by an adaptive-stochastic codebook combination while unvoiced sounds would now be approximated by the sum of 2 stochastic codebooks. For purposes of description, these two codebooks are named CB0 and CB1. The combined search approach is referred to herein as a CB0-CB1 codebook analysis while the other choice is referred to as an LTP-CB1 codebook analysis. It is noted that CB0 and CB1 may in fact be identical codebooks (i.e. contain the same set of possible codevectors), it is just that a different codevector is selected from each in such a way that the sum of the two selected codevectors best approximates the input speech.

One problem with this approach is that the decision of whether a particular subframe is occupied by voiced or unvoiced speech is usually very difficult to make and often prone to error. The approach adopted in the present invention and described below trades making the optimal decision at the expense of an increase in complexity. However, by operating processor 52 faster (using a clock signal having a higher frequency) the goal of quick codebook searching is still achieved.

Figure 2:
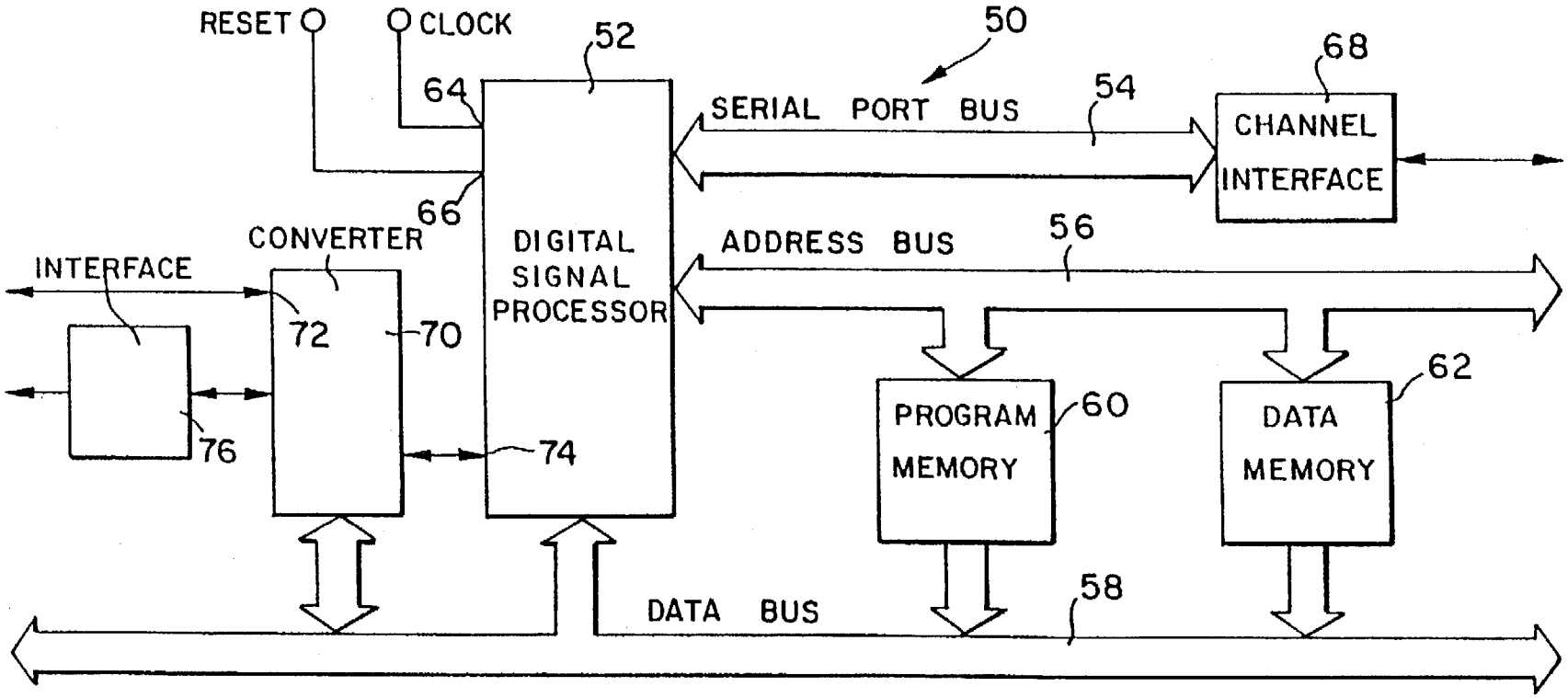
FIG. 2 is a schematic view of an adaptive speech coder in accordance with the present invention.

An adaptive CELP coder constructed in accordance with the present invention is depicted in FIG. 2 and is generally referred to as 50. The heart of coder 50 is a digital signal processor 52, which in the preferred embodiment is a TMS320C51 digital signal processor manufactured and sold by Texas Instruments, Inc. of Houston, Tex. Such a processor is capable of processing pulse code modulated signals having a word length of 16 bits.

Processor 52 is shown to be connected to three major bus networks, namely serial port bus 54, address bus 56, and data bus 58. Program memory 60 is provided for storing the programming to be utilized by processor 52 in order to perform CELP coding techniques in accordance with the present invention. Such programming is explained in greater detail in reference to FIGS. 3 through 6. Program memory 60 can be of any conventional design, provided it has sufficient speed to meet the specification requirements of processor 52. It should be noted that the processor of the preferred embodiment (TMS320C51) is equipped with an internal memory. Data memory 62 is provided for the storing of data which may be needed during the operation of processor 52.

A clock signal is provided by conventional clock signal generation circuitry (not shown) to clock input 64. In the preferred embodiment, the clock signal provided to input 64 is a 40 MHz clock signal. A reset input 66 is also provided for resetting processor 52 at appropriate times, such as when processor 52 is first activated. Any conventional circuitry may be utilized for providing a signal to input 66, as long as such signal meets the specifications called for by the chosen processor.

Processor 52 is connected to transmit and receive telecommunication signals in two ways. First, when communicating with CELP coders constructed in accordance with the present invention, processor 52 is connected to receive and transmit signals via serial port bus 54. Channel interface 68 is provided in order to interface bus 54 with the compressed voice data stream. Interface 68 can be any known interface capable of transmitting and receiving data in conjunction with a data stream operating at the prescribed transmission rate.

Second, when communicating with existing 64 kb/s channels or with analog devices, processor 52 is connected to receive and transmit signals via data bus 58. Converter 70 is provided to convert individual 64 kb/s channels appearing at input 72 from a serial format to a parallel format for application to bus 58. As will be appreciated, such conversion is accomplished utilizing known codecs and serial/parallel devices which are capable of use with the types of signals utilized by processor 52. In the preferred embodiment processor 52 receives and transmits parallel sixteen (16) bit signals on bus 58. In order to further synchronize data applied to bus 58, an interrupt signal is provided to processor 52 at input 74. When receiving analog signals, analog interface 76 serves to convert analog signals by sampling such signals at a predetermined rate for presentation to converter 70. When transmitting, interface 76 converts the sampled signal from converter 70 to a continuous signal.

With reference to FIGS. 3–7, the programming will be explained which, when utilized in conjunction with those components shown in FIG. 2, provides a new and novel CELP coder. However, first consider some preliminary operations. Telecommunication signals to be coded and transmitted appear on bus 58 and are presented to an input buffer (not shown). Such telecommunication signals are sampled signals made up of 16 bit PCM representations of each sample where sampling occurs at a frequency of 8 kHz. For purposes of the present description, assume that a voice signal sampled at 8 kHz is to be coded for transmission. The input buffer accumulates a predetermined number of samples into a sample block. In the preferred embodiment, a frame includes 320 samples and further that each frame is divided into 5 subframes each being 64 samples long. As will be described below, the codevectors drawn from the stochastic codebook used in the CELP coder of the present invention consist of either a bipulse codevector (BPC) or scrambled Hadamard codevector (SHC). The choice of whether a BPC or SHC codevector is selected will be based on which best matches the input speech.

As indicated previously, each frame of speech samples is divided into 5 subframes. As will be explained below certain operations are performed on each subframe, groups of subframes and finally on the entire frame. Consider now the operation of processor 52 in coding speech signals in accordance with the present invention.

Initially, LPCs are determined for each block of speech samples. The technique for determining the LPCs can be any desired technique such as that described in U.S. Pat. No. 5,012,517—Wilson et al., incorporated herein by reference. It is noted that the cited U.S. patent concerns adaptive transform coding, however, the techniques described for determining LPCs are applicable to the present invention. The determined LPCs are formatted for transmission as side information. The determined LPCs are also provided for further processing in relation to forming an LPC synthesis filter.

The ringing vector associated with the synthesis filter is removed from the speech signal, thereby forming the target vector x. The so-modified speech signal is thereafter provided for codebook searching in accordance with the present invention.

As will be described herein, two forms of codebook searching are performed in the present invention, namely, bi-pulse searching and scrambled searching. Consider first the bi-pulse searching technique shown in FIG. 3. It will be recalled that codebooks can be populated by many hundreds of possible vectors c. Since it is not desirable to form Ac or $c^tA^t$ for each possible vector, procomputing two variables occurs before the codebook search, the (N-by-1) vector d and the (N-by-N) matrix F (equation 9). The process of pre-forming d by backward filtering is performed at 78.

Since the codebook search forms such a critical part of the total computations in CELP coding, it's vital that efficient search strategies be used to compute the best codeword. However, it is just as important to have a codebook in place which allows the computation of $C_i$, $G_i$ in an efficient manner.

Two major requirements on codebook vectors c are (i) that they have a flat frequency spectrum (since they will be shaped into the correct form for each particular sound by the synthesis filter) and (ii) that each codeword is sufficiently different from each other so that entries in the codebook are not wasted by having several almost identical to each other.

In the present invention all the entries in the bi-pulse codebook effectively consist of an (N-by-1) vector which is zero in all of its N samples except for two entries which are +1 and −1 respectively. As indicated previously, the preferred value of N for each subframe is 64, however, in order to illustrate the principles of the invention, a smaller number of samples per vector is shown.

Thus each codevector c is of the form:

$$c = \begin{bmatrix} 0 \\ 0 \\ \cdot \\ \cdot \\ \cdot \\ 0 \\ 1 \\ 0 \\ \cdot \\ \cdot \\ \cdot \\ 0 \\ -1 \\ 0 \\ \cdot \\ \cdot \\ \cdot \\ 0 \end{bmatrix} \begin{array}{l} \\ \\ \\ \\ \\ \\ \text{row } i \\ \\ \\ \\ \\ \\ \\ \text{row } j \\ \\ \\ \\ \\ \\ \end{array}$$

This form of vector is called a bi-pulse vector since it has only two non-zero pulses. This vector has the property of being spectrally flat as desired for codebook vectors. Since the +1 pulse can be in any of N possible positions and the −1 pulse can be in any one of (N−1) positions, the total number of combinations allowed is N(N−1). Since it is preferred that N equal 64, the potential size of the codebook is 4032 vectors. It is noted that use of a bi-pulse vector for the form of the codebook vector permits all the speech synthesis calculations by knowing the positioning of the +1, −1 pulses in the codevector c. Since only position information is required, no codebook need be stored. Therefore, the effect of a very large codebook can be achieved without requiring a large storage capacity.

Due to the nature of the bi-pulse vector, i.e., zeros in all positions except two which contain either +1 or −1, the computations previously required to calculate equation (10), reduce to:

$$C_i=(d_i-d_j)$$

$$G_i=(F_{jj}+F_{ii}-2F_{ij}) \tag{11}$$

where $d_i$ is the element i of the vector d, $d_j$ is the element j of the vector d and $F_{ij}$ is the element in row i and column j of the matrix F. In other words, by using a bi-pulse codeword having a single +1 and a single −1 component, the search for the optimum codeword reduces to determining position information only, which in turn reduces to manipulating the values in the d vector and the F matrix in accordance with equation (11).

The primary advantages of using this effective bi-pulse codebook are: very large effective codebook size (4032 vectors)—thus allowing good speech quality; very low storage requirement—the "codebook" itself need not be stored as the effect can be computed as in equation (11); and low computational requirement since it's very simple to compute $C_i$, $G_i$ (to find the maximum $\hat{E}$) as shown in equation (11).

During a traditional codebook search, only that part of the filtered vector Ac which falls within the current frame is optimized and the portion that carries on to the next frame is ignored. In this way, the values of $C_i$, $G_i$ are more accurate for those codebook vectors c which have pulses at the start of the frame than those that have pulses later on in the frame.

In the present invention, the problem of an ignored portion of the filtered vector is overcome by truncating impulse response $\{a_n\}$ of the LPC synthesis filter to a small number of values, i.e, use a new impulse response $\{a'_n\}$ defined as:

$$\begin{aligned} a'_n &= a_n, \quad n=O \text{ to } NTRUNC-1 \\ &= 0 \quad n=NTRUNC \text{ to } N-1 \end{aligned} \tag{12}$$

Figure 3:
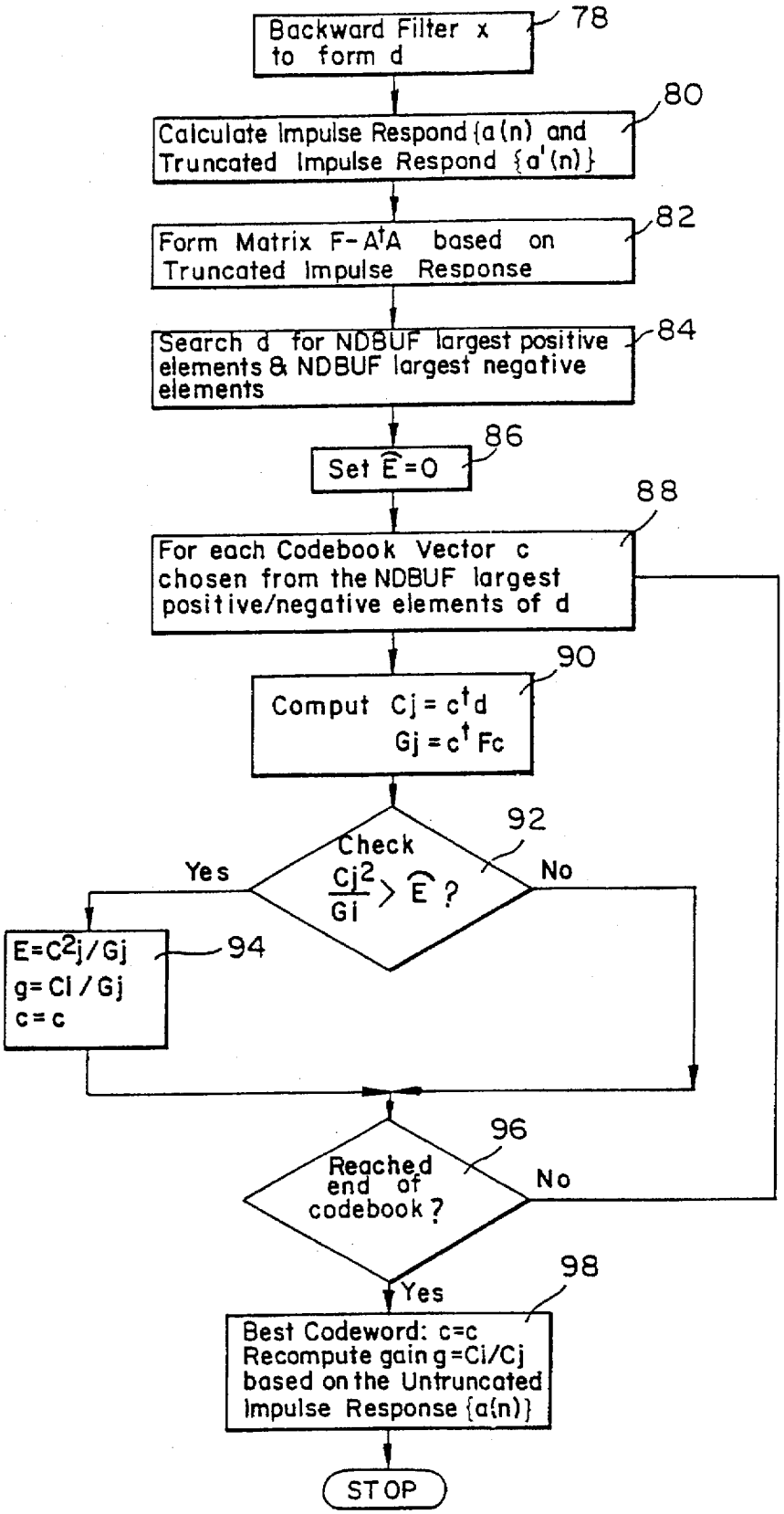
FIG. 3 is a flow chart of a codebook search technique in accordance with the present invention.

This calculation of the impulse response and its truncation are performed at 80 in FIG. 3.

As indicated previously, the impulse response of the synthesis filter contains 64 values, i.e. N=64. In the truncated modification, the original impulse response is chopped off after a certain number of samples. Therefore, the energy produced by the filtered vector Ac will now be mostly concentrated in this frame wherever the pulses happen to be. It is presently preferred for the value of NTRUNC to be 8. Precomputing the (N-by-N) matrix F (equation 9), based on the truncated impulse response, is performed at 82.

It's important to note that this truncation is only performed for the bi-pulse codebook search procedure, i.e, to compute $C_i$, $G_i$ for each codebook vector c. After the best codeword c has been found by maximizing $C_i^2/G_i$, a new set of $C_i$, $G_i$ for this particular codeword are computed based on the full impulse response $\{a_n\}$ and this full response computation is used to calculate a new gain $g=C_i/G_i$.

The full response computation is used for the gain calculation since, although the truncated impulse response evens up the chances of all pulse positions being picked for a particular frame, the values of $C_i$, $G_i$ produced by the bi-pulse process are not quite "exact" in the sense that they no longer exactly minimize the error between the gain-scaled filtered codevector gAc and the target vector x. Therefore, the un-truncated response must be used to compute the value of the gain g which does actually minimize this error.

It will be recalled that $C_i^2/G_i$ and $C_i/G_i$ were also used in traditional codebook searching in order to find the best codeword and the appropriate gain. By use of the present invention, these values are calculated more quickly. However, the time necessary to calculate the best codebook vector and the efficiency of such calculations can be improved even further.

It will be recalled that in the preferred embodiment N=64. Consequently, even the simplified truncated search described above still requires the computation of $C_i$, $G_i$ for N(N−1) or 4,032 vectors and this would be prohibitive in terms of the processing power required. In the present invention only a very small subset of these possible codewords is searched. This reduced search yields almost identical performance to the full codebook search.

To understand this concept, consider the structure of $G_i$ a little more closely. If the filtered codevector Ac is represented as the vector y, i.e., $$y=Ac \tag{13}$$

then transposing both sides of this equation yields, $$y^t=c^tA^t \tag{14}$$

Equation (10) for $G_i$ then becomes:

$$G_i=y^ty=\sum_{n=0}^{N-1} y(n)^2 \tag{15}$$

where {y(n} for n=0 to N−1} is the set of samples which make up the vector y. This equation states that $G_i$ is actually the correlation of the filtered codebook vector y with itself (i.e, the total energy in this signal). If the two pulses in the codebook vector are widely spaced, the filter response to the +1 pulse will not interact with the response to the −1 pulse and thus the total energy in the filtered vector y will be very consistent and fairly independent of where these +1, −1 pulses actually are located within the frame.

This implies that $G_i$ will actually not vary too much with the pulse positions. Thus maximizing $C_i^2/G_i$ during the codebook search is approximately equivalent to maximizing just $C_i$ and this simplifies the codebook search considerably. This process of just maximizing $C_i$ is called a "numerator only search" since it only involves computation of the numerator $C_i$ from the expression $C_i^2/G_i$. It was noted that the use of the truncated impulse response described above cuts short the filter response to each of the +1,−1 pulses and so there is less chance that the two responses will interact with each other. This makes the assumption, that $G_i$ is fairly independent of pulse position more valid.

By using a numerator only search, equation (11) can be modified as $C_i=(d_i-d_j)$. Therefore, to maximize the value of $C_i$, only the largest possible positive value for $d_i$ and the largest possible negative value for $d_i$ are required. Thus, the codebook search procedure just consists of scanning the d vector for its largest positive component which reveals i (the position of the +1 within the codebook vector c) and the largest negative component which reveals j (the position of the −1 within the codebook vector c).

The numerator only search is much simpler than the alternative of computing $C_i$, $G_i$ for each codevector. However, it relies on the assumption that $G_i$ remains constant for all pulses positions and this assumption is only approximately valid—especially if the +1, −1 pulses are close together. To alleviate this condition, instead of just finding the one largest positive value and one largest negative value in the backward filtered vector d, a search is made for a number (NDBUF) of the largest positive values (where NDBUF is a number greater than 1) and NDBUF largest negative values.

This plural search yields sample positions within d at which these maximum positive and the maximum negative values occur, i.e. $\{i_max_k$ for k=1 to NDBUF$\}$ and $\{j_min_1$ for 1=1 to NDBUF$\}$ respectively. The actual largest positive and largest negative values are, therefore, given by $\{d(i_max_k)$ for k=1 to NDBUF$\}$ and $\{d(j_min_1)$ for 1=1 to NDBUF$\}$. The assumption is now made that, even allowing for the slight variation in $G_i$ with pulse position, the "best" codeword will still come from the pulse positions corresponding to these two sets $\{d(i_max_k)\}$, $\{d(j_min_1)\}$.

As shown in FIG. 3, this numerator only search to select NDBUF largest positive elements and NDBUF largest negative elements is performed at 84. The energy value $\hat{E}$ is set to zero at 86.

For each of the plurality of NDBUF values, $C_i$, $G_i$ can now be computed at 88, 90 from the following modification of equation (11), $$\begin{aligned} C_i &= d(i_max_k) - d(j_min_l) \\ G_i &= F(i_max_k, i_max_k) + F(j_min_l, j_min_l) - \\ &\quad 2F(i_max_k, j_min_l) \end{aligned} \tag{16}$$

where F(i,j) is the element in row i, column j of the matrix F. Using the $C_i$, $G_i$ equations, the maximum $C_i^2/G_i$ is determined in the loop including 88, 90, 92, 94 and 96. $C_i$, $G_i$ are computed at 90. The value of $\hat{E}$ or $C_i^2/G_i$ is compared to the recorded value of $\hat{E}$ at 92. If the new value of $\hat{E}$ exceeds the recorded value, the new values of $\hat{E}$, g and c are recorded at 94. The loop continues until all NDBUF variations of i and j are computed, which is determined at 96. The values for both $i_max_k$, $j_min_1$ are thus found for the best pulse positions for the codeword c. It is this value of i and j, i.e. the position of +1 and −1 in the codevector c, which will be transmitted.

It will be seen that the set of computations for equation (16) is performed for each possible $i_max_k$, $j_min_l$. Since there are NDBUF of each, this implies a total of $NDBUF^2$evaluations of $C_i$, $G_i$. It has been found that a value of NDBUF=5 provides similar performance to the full search of calculating $C_i^2/G_i$ for each possible set of pulse positions.

In summary, the complexity reduction process of doing a numerator-only search has the effect of winnowing down the number of codevectors to be searched from approximately 4000 to around 25 by calculating the largest set of $C_i$ values based on the assumption that $G_i$ is approximately constant. For each of these 25, both $C_i$, $G_i$ (using the truncated impulse response) are then computed and the best codeword (position of +1 and −1) is found. For this one best codeword, the un-truncated impulse response is then used to compute the codebook gain g at 98. Both positions i and j as well as the gain g are provided for transmission.

Figure 1A:
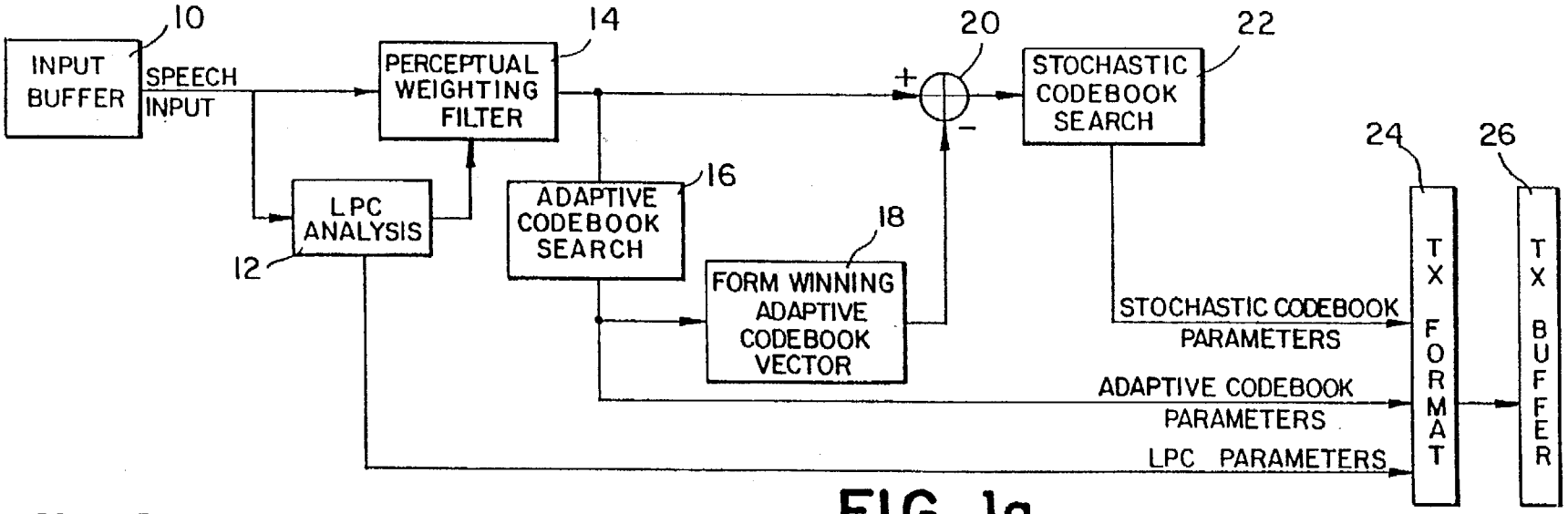
FIG. 1a PRIOR ART
FIG. 1(*a*) is a block diagram of the transmission portion of a prior art generalized CELP vocoder-transmitter.
Figure 1B:
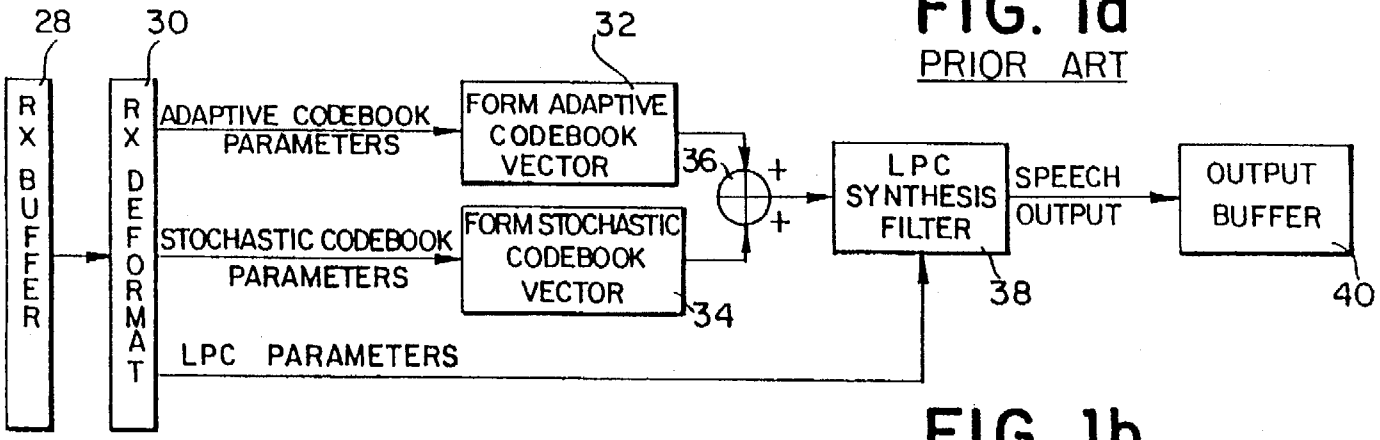
FIG. 1b PRIOR ART
Figure 4:
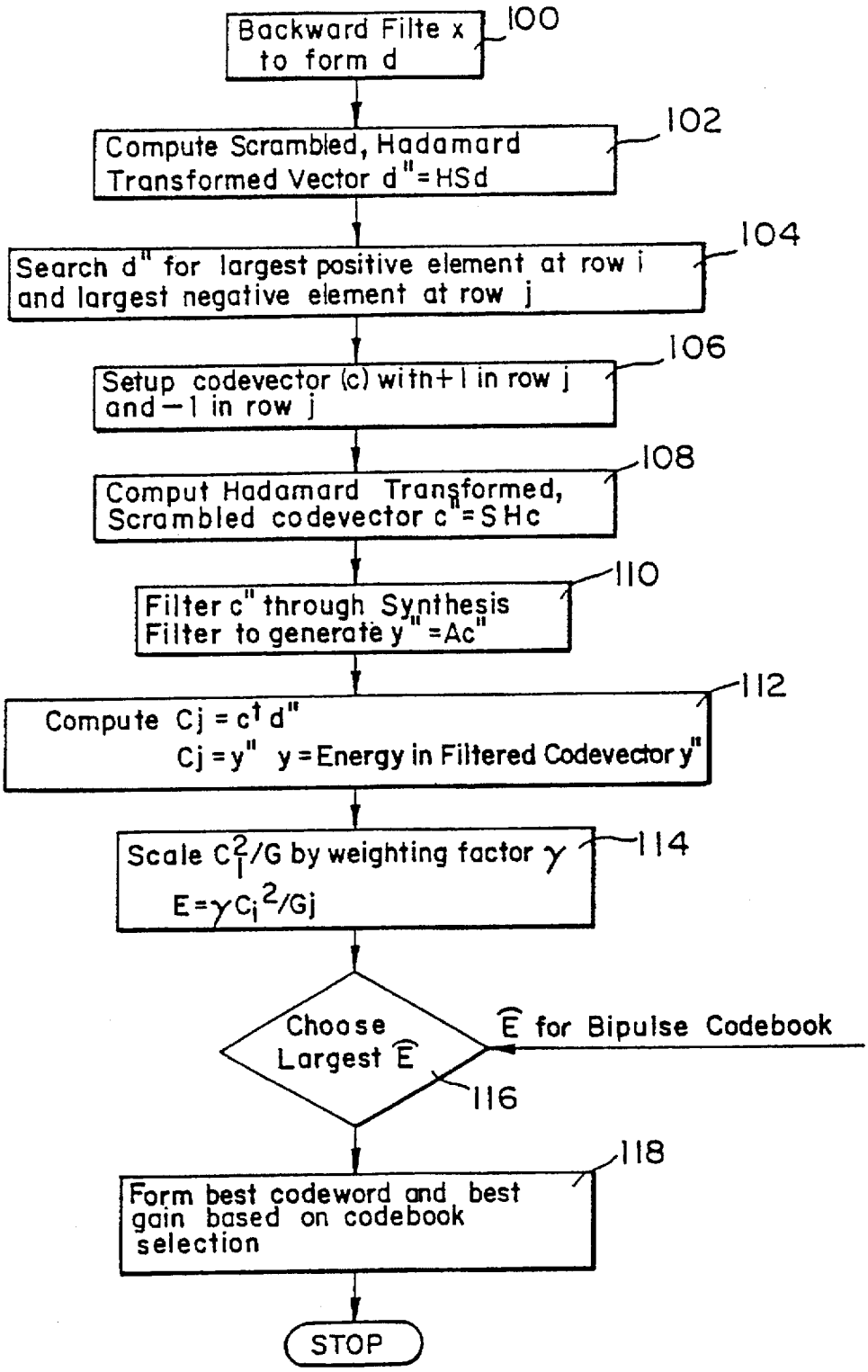
FIG. 4 is a flow chart of another codebook search technique in accordance with the present invention.

Consider now the scrambled codebook searching technique shown in FIG. 4. For voiced sounds (i.e. vowels and sounds such as z, r, l, w, n that have a definite periodicity) the excitation to the LPC synthesis filter 38 in FIG. 1(*b*) is provided to a large extent by the LTP—i.e. βis large and g is small. However, unvoiced sounds have no periodicity and so must be modeled by the codebook. Using the bi-pulse search technique for such modelling, however, is only partially successful.

Unvoiced sounds can be classified into definite types. For plosives (e.g. t, p, k), the speech waveform resembles a sharp pulse which quickly decays to almost zero. The bi-pulse codebook described above is very effective at representing these signals since it itself consists of pulses. However, the other class of unvoiced signals is the fricatives (e.g. s, sh, f) which have a speech waveform which resembles random noise. This type of signal is not well modeled by the sequence of pulses produced by the bi-pulse codebook and the effect of using bi-pulses on these signals is the introduction of a very coarse raspiness to the output speech.

One solution to this problem would be to use a traditional random (stochastic) codebook based on noise-like waveforms in parallel with the bi-pulse codebook so that the bi-pulse codebook was used when it modeled the signal best, while the random codebook was used to model the certain types of unvoiced speech for which it was most appropriate. However, the disadvantage of this approach is that, as mentioned before, the random codebook is much more difficult to search than the bi-pulse codebook.

The ideal solution would be to take the bi-pulse codebook vectors and transform them in some way such that they produced noise-like waveforms. Such an operation has the additional constraint that the transformation be easy to compute since this computation will be done many times in each frame. The transformation of the preferred embodiment is achieved using the Hadamard Transform. While the Hadamard Transform is known, its use for the purpose described below is new.

The Hadamard transform is associated with an (N-by-N) transform matrix H which operates on the codebook vector c. Hadamard transforms exist for all sizes of N which are a power of 2 so, for instance, the transform matrix associated with N=8 is as follows:

$$H = \begin{bmatrix} 1 & 1 & 1 & 1 & 1 & 1 & 1 & 1 \\ 1 & -1 & 1 & -1 & 1 & -1 & 1 & -1 \\ 1 & 1 & -1 & -1 & 1 & 1 & -1 & -1 \\ 1 & -1 & -1 & 1 & 1 & -1 & -1 & 1 \\ 1 & 1 & 1 & 1 & -1 & -1 & -1 & -1 \\ 1 & -1 & 1 & -1 & -1 & 1 & -1 & 1 \\ 1 & 1 & -1 & -1 & -1 & -1 & 1 & 1 \\ 1 & -1 & -1 & 1 & -1 & 1 & 1 & -1 \end{bmatrix} \tag{17}$$

Two general points to be noted about this transform matrix, which also apply for all values of N are:

(i) All the elements are +1, −1 with half the matrix being composed of each.

(ii) The transform matrix is symmetric, i.e, $H=H^t$.

Now, an (N-by-1) transformed codebook vector c' can now be formed that is related to the bi-pulse codebook vector c as:

$$c'=Hc \tag{18}$$

This transformed codevector can be used in equation (8) in place of c to compute $G_i$, $C_i$ and thereby find the best codevector. Since c has only two non-zero elements with the +1 at row i and the −1 at row j, the effect of forming the transform c'=Hc is such that c' is now:

$$c'=(\text{column i of H})-(\text{column j of H}) \tag{19}$$

The transformed codevector c' will have elements which have one of the three values 0,−2,+2. The actual proportion of these three values occurring within c' will actually be ½, ¼, ¼ respectively. This form of codevector is called a ternary codevector (since it assumes three distinct values). While ternary vectors have been used in traditional random CELP codebooks, the ternary vector processing of the invention is new.

There is, however, one problem with this new approach. From equation (17), the columns (or rows) of H exhibit sign changes from +1 to −1 and vice versa of varying frequency. The frequency by which the sign changes is formalized in the term sequency which is defined as:

$$\text{sequency} = \frac{\text{total number of sign changes in any column}}{2}$$

The transform matrix H has a very wide range of sequencies within its columns. Since c' is composed of a combination of columns of H as in equation (19), the vector c' will have similar sequency properties to H in the respect that in some speech frames there will be many changes of sign within c' while other frames will have c' vectors with relatively few changes. The actual sequency will depend on the +1,−1 pulse positions within c.

A high sequency c' vector has the frequency transform characteristic of being dominated by lots of energy at high frequencies while a low sequency c' has mainly low frequency components. The effect of this wide range of sequency is that there are very rapid changes in the frequency content of the output speech from one frame to the next. This has the effect of introducing a warbly, almost underwater effect to the synthesized speech.

It is therefore desirable to modify this approach which, while still producing noise-like codevectors such as the ternary codewords c', will yield a more consistent sequency in the codewords from one frame to the next. In the preferred embodiment, the result of more consistent sequency is achieved by introducing a "scrambling matrix" S of the form:

$$S = \begin{bmatrix} \pm1 & 0 & 0 & \cdots & 0 \\ 0 & \pm1 & 0 & \cdots & 0 \\ 0 & 0 & \pm1 & \cdots & 0 \\ \vdots & \vdots & \vdots & \ddots & \vdots \\ 0 & 0 & 0 & \cdots & \pm1 \end{bmatrix} \quad (20)$$

where the elements along the main diagonal are randomly chosen as +1 or −1. In an especially preferred embodiment, a predetermined, fixed choice of +1 and −1 is used which does not change with time or on a frame-to-frame basis. It will be recalled that in the preferred embodiment N is 64. The preferred 64 diagonal values for the scrambling matrix S are as follows: −1, −1, −1, −1, −1, −1, 1, −1, 1, 1, −1, −1, −1, 1, 1, −1, −1, 1, 1, 1, 1, 1, −1, −1, 1, 1, 1, 1, −1, 1, 1, 1, 1, 1, −1, −1, −1, 1, −1, −1, 1, −1, 1, −1, −1, −1, 1, −1, 1, 1, 1, −1, 1, −1, −1, −1, −1, 1, 1, −1, −1, 1, −1, −1.

The new transformed and scrambled codevector c" is then given by:

$$c''=SHc \quad (21)$$

The effect of the S matrix is to take each element in c'=Hc and either invert its sign or not, at random. This results in the sequency properties of c' being "broken up" so that the resulting vectors c" have almost the same sequency no matter where the pulse positions are within the bi-pulse vector c. However, c" is still composed of the values (0, +2, −2) in the same proportion as before and so the noise-like properties of the codebook are retained. The net effect of the use of this scrambling matrix is to remove the warble-like distortion and produce a more natural noise-like output for speech inputs such as the sounds s, f.

It may seem that the addition of these two matrices S, H would dramatically increase the complexity of this approach. However, although there is some increase, it is by no means prohibitive.

Referring to FIG. 4, it is again noted that the target vector x, having been previously generated is backward filtered to form vector d at 100.

The two parameters to be computed for each codeword c" are, as before, $C_i$, $G_i$ which are formed by replacing c by c" in equation (8):

$$Ci=c''^t A^t x$$

$$Gi=c''^t A^t Ac'' \quad (22)$$

Now, from equation (21), $c''^t=c^t H^t S^t$, and using the property that both H, S are symmetric (i.e, $H^t=H$ and $S^t=S$), we get:

$$C_i=c^t H^t S^t A^t x=c^t HSA^t x$$

$$G_i=c^t H^t S^t A^t ASHc=c^t HSA^t ASHc \quad (23)$$

In describing the technique of backward filtering above, the idea was to precompute $d=A^t x$ to avoid having to form $c^t A^t$ for each codevector c. A similar idea can be used in equation (23) to precompute d" at 102 such that:

$$d''=HSA^t x \quad (24)$$

This computation is made up of three stages: (i) the calculation of $A^t x$ is just the backward filtering operation described above, (ii) the multiplication by the scrambling matrix S matrix is trivial since it just involved inverting the sign of certain entries. It will be noted that only the +1, −1 entries in S need be stored in memory rather than the whole (N-by-N) matrix), (iii) the Hadamard transform can be computed efficiently by fast algorithms.

Once d" has been computed, all that remains is to compute $C_i$ from:

$$C_i=c^t d'' \quad (25)$$

where c is still the bi-pulse vector. This is exactly the same as equation (10) with d being replaced by d" and so the same principles used to simplify the search for the bi-pulse codebook are also used with this scrambled Hadamard codebook (SHC). In particular, the numerator-only search can be employed to reduce the number of codebook entries searched from N(N−1) to $NDBUF^2$. For these $NDBUF^2$ possibilities, both $C_i$, $G_i$ are then computed and the codeword which maximizes $C_i^2/G_i$ is found. We can now examine the computation of $G_i$ a little more closely.

If we let y"=Ac", then equation (22) can be rewritten as:

$$G_i=y''^t y'' \quad (26)$$

which is just the correlation of this filtered signal y" with itself. However, this expression cannot be simplified much further and so this approach must be used to calculate $G_i$. Since this process is somewhat expensive computationally (although not prohibitively so), it is desirable to minimize the number of times this computation is required. Since $G_i$ is only calculated $NDBUF^2$ times, a value of NDBUF=1 is preferably chosen. This implies that only the largest positive and largest negative entries in the vector d" are searched at 104 and the positions of these extreme values give the pulse positions in the codevector c generated at 106. The scrambled codevector c" is formed at 108 and filtered through the LPC synthesis filter to form y" at 110. At 112 the value $C_i$ is formed using equation (25) and the value $G_i$ is then formed using equation (26) both with the un-truncated impulse response and the gain $g=C_i$, $G_i$ can finally be evaluated.

In operation, two stochastic codebook search techniques are utilized in the present invention. Consequently, it must be decided which codebook vector to use during any particular subframe. The decision generally involves determining which codebook vector minimizes the error between the synthesized speech and the input speech signal or equivalently, which codebook vector has the largest value for $C_i^2/G_i$. Because the SHC is so different from the bi-pulse a slight modification is required.

The reason for the modification is that the SHC was designed to operate well for fricative unvoiced sounds (e.g. s, f, sh). The speech waveforms associated with these sounds are best described as being made up of a noise-like waveform with occasional large spikes/pulses. The bi-pulse codebook will represent these spikes very well but not the noise component, while the SHC will model the noise component but perform relatively poorly on the spikes.

Since the maximization of $C_i^2/G_i$ is associated with the minimization of a squared error between input and synthesized speech signals, an error at the spikes is weighted very heavily in the total error and so the SHC will occasionally produce large squared errors even for fricative speech inputs. However, the squared error is not necessarily the best error criterion since the ear itself is sensitive to signals on a dB (or log) scale which gives small signals a larger importance relative to larger signals than a squared error criterion would imply. This means that, even if choosing the SHC would be the best decision perceptually, the squared error criterion may not come to the same final choice.

Therefore, it is necessary to artificially weigh the decision at 114 in favor of the SHC. The way in which this is achieved, referring again to FIG. 4, is by computing $C_i^2/G_i$ for each of the codebooks and then multiplying that for the SHC by a weighting factor $\gamma$ at 114 before comparing it with the corresponding values for the other codebook. It is preferred to use a value of $\gamma=1.25$. This value ensures that the SHC is chosen for those signals on which it performs best (e.g. unvoiced fricatives and other noisy signals) while the bi-pulse and single-pulse codebooks are used for signals such as plosives. The largest value of $\hat{E}$ is chosen at 116 and the best codeword and gain g are formed at 118 and provided for formatting and provision to a Tx buffer for provision to bus 54 (FIG. 2).

As indicated previously, the present invention determines when it is desirable to dispense with the adaptive (LTP)/stochastic codebook approach and use a two (2) stochastic codebook approach. This procedure is detailed in relation to a single subframe in FIG. 5(*a*). As shown, the speech signal is actually used as the input to each of the two possible types of codebook searches, i.e. LTP-CB1 or CB0-CB1, wherein the codebook target vector x is computed at 120. It is noted that each stochastic codebook search itself is made up of BPC and SHC search components described above in relation to FIGS. 3 and 4.

Figure 5A:
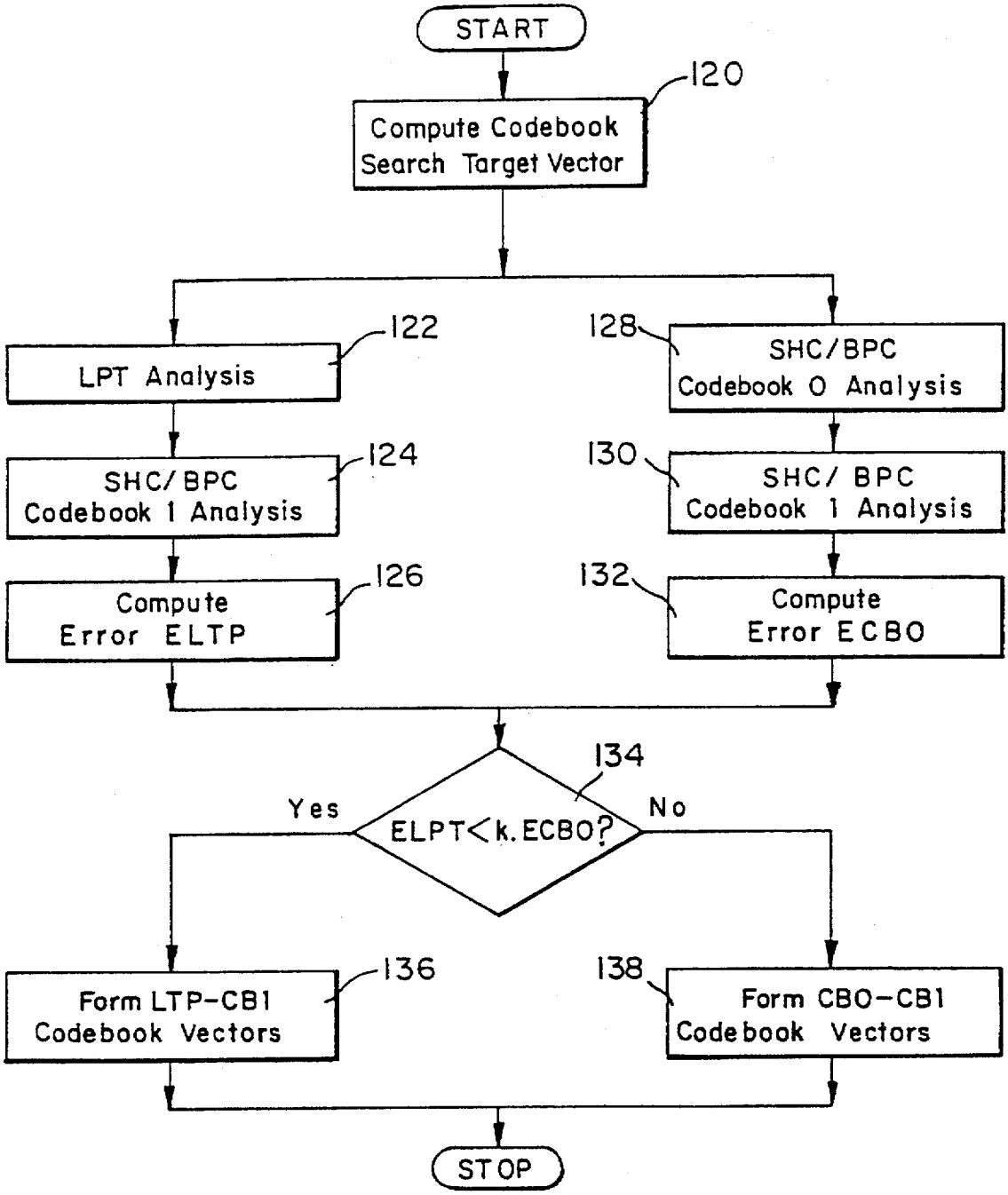
FIG. 5(*a*) is a flow chart of those operations performed in the adaptive coder shown in FIG. 2, prior to transmission, wherein a multiple codebook analysis is performed over a single subframe.
Figure 5B:
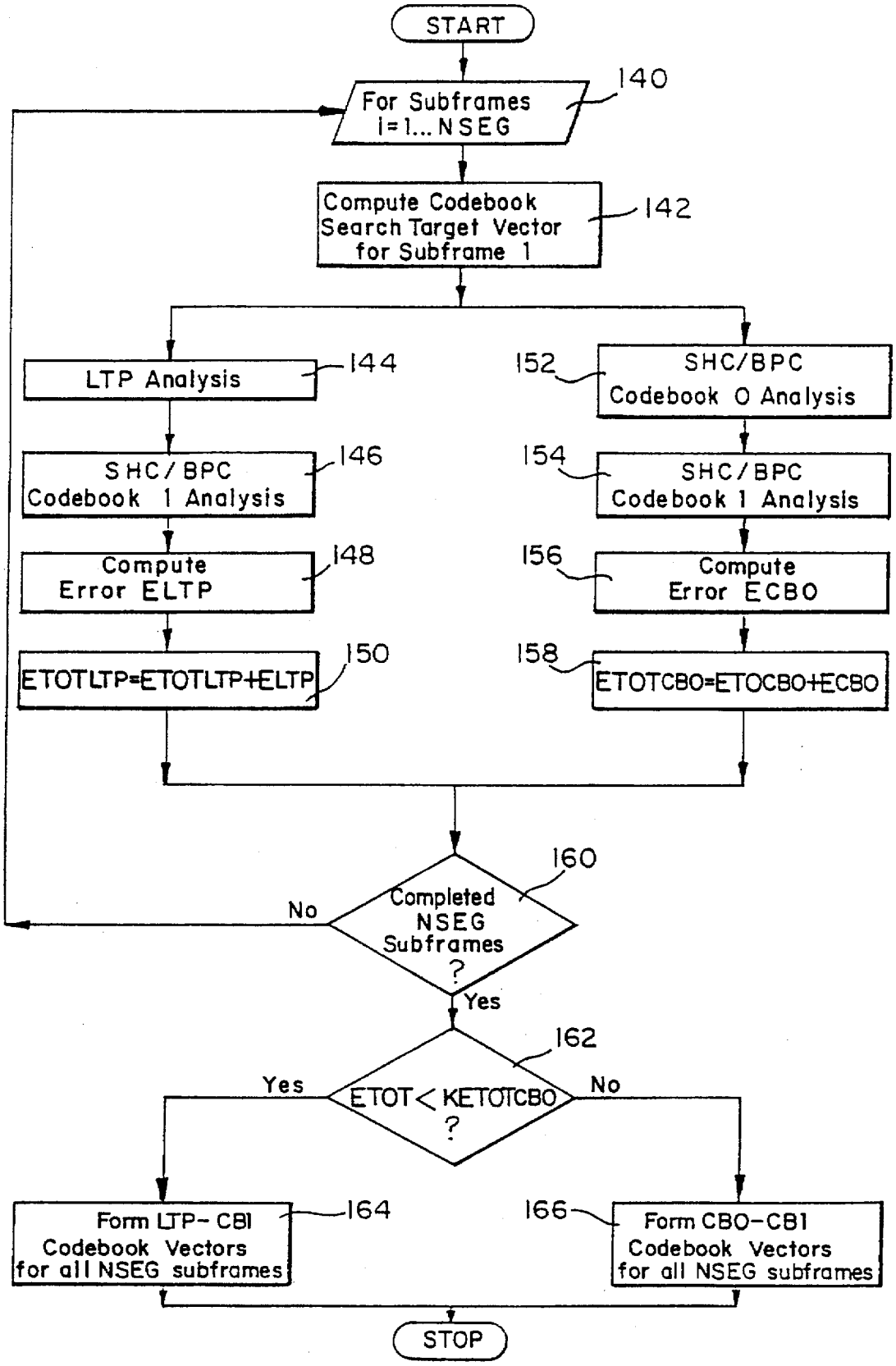

As shown in FIG. 5(*a*), LTP analysis of the target vector occurs at 122. The scrambled Hadamard codeword/bi-pulse codeword (SHC/BPC) searches are performed at 124. The error between the synthesized and input speech signals is computed at 126 (actually the error associated with the codeword developed at 118). Concurrently, the SHC/BPC search for Codebook 0 is performed at 128 and subtracted from the target vector x. The resultant vector is searched in the SHC/BPC search for Codebook 1 at 130. The error between the synthesized and input speech signals is computed at 132 (actually the error associated with the codeword developed at 118 for Codebook 1).

In other words, at the end of both sets of searches, the error between the synthesized and input speech signals is computed for both LTP-CB0 (i.e. $E_{LTP}$) and for CB0-CB1 (i.e. $E_{CB0}$). As it has been found that a slight bias towards LTP-CB0 improves the output speech quality, the error $E_{LTP}$ is compared at 134 with $k.E_{CB0}$ - i.e. a scaled down version of $E_{CB0}$ so that $k<1$. It is preferred for k to equal 1.14. If the LTP-CB1 combination produces the lower error then it is used to produce the winning codevectors at 136; otherwise this task goes to the two stochastic codebooks CB0-CB1 at 138.

This entire process has the considerable advantage that the optimal decision of which two types of codebook to use is always reached. However, this desirable result is achieved at the expense of an increase in processing power as each of the two sets of codebook searches has to be analyzed before the decision can be made. However, at the 40 Mhz operating frequency of processor 52, such increased processing power is at acceptable levels.

As the choice of LTP-CB0 or CB0-CB1 is made independently on each and every subframe, it is quite possible for certain types of speech sound that can neither be classified as entirely voiced or entirely unvoiced, that the decision can toggle back and forth on each subframe between each of the two possibilities and this can lead to some degradation in the output speech. One way to deal with this problem is to compute $E_{LTP}$ and $E_{CB0}$ as before but then to postpone the actual decision until the same process has been repeated for NSEG subframes and both sets of errors have been accumulated to form $ETOT_{LTP}$ and $ETOT_{CB0}$. These two errors can then be compared and a decision can be reached as to whether all NSEG subframes should be represented by either the LTP-CB0 or CB0-CB1 combinations. This multiple subframe process is illustrated in FIG. 5(*b*).

As shown in FIG. 5(*b*), each frame of speech samples is divided into subframes and a subframe integer value is selected and incremented at 140. Similar to FIG. 5 (*a*) a target vector is computed at 142. An LTP/Codebook 1 analysis is performed at 144, 146 and the error associated with the resulting codebook vector is computed at 148 this error value is added to $ETOT_{LTP}$ at 150. Concurrently, CB0 and CB1 searches (similar to that described in relation to FIG. 5(*a*)) are performed at 152 and 154. The error associated with the resulting codebook vector is computed at 156 and added to $ETOT_{CB0}$ at 158. After it is determined at 160 that NSEG subframes have been analyzed, a comparison is made at 162 to determine whether $ETOT_{LTP}$ is lower than $ETOT_{CB0}$. If $ETOT_{LTP}$ is lower, the LTP-CB1 codevector is formed at 164 for NSEG subframes. If $ETOT_{CB0}$ is lower, the CB0-CB1 codevector is formed at 166 for the NSEG subframes.

It should be noted that this process does not actually require more of a processing load than making a decision every subframe as each of the two sets of codebook are still analyzed for each subframe, it is only the decision that is made once all NSEG sets of searches have been completed.

In the preferred embodiment, the first two subframes are treated as one segment for this decision (i.e. NSEG=2) and similarly for the next two. The fifth and final subframe within each frame (320 samples per frame with each subframe having 64 samples) is then treated as an independent unit (i.e. NSEG=1).

Thus it will be appreciated from the above that for each segment two (2) codebooks are implemented, where one codebook will change from adaptive to stochastic and vice versa based on the nature of the input signal. Even though such a dual codebook search technique improves the quality of the synthesized speech, such quality can be improved even further.

There are three specific changes that can be made to the stochastic codebooks employed in CELP coders in order to increase the voice quality. These are (i) to change the nature of the codevectors in the codebook, (ii) to increase the size of the codebook and (iii) to add more stochastic codebooks. Of these, by far the greatest perceptual improvement can be achieved by the final option of adding another codebook. This involves performing the same analysis as before for the adaptive+stochastic codebook combination, except that, after the first stochastic codebook search is completed, the effect of this winning codevector is removed from the target vector to form a new target which is input to the second stochastic codebook search.

The only disadvantage with this approach of adding codebooks is that it requires a substantial increase in the total number of bits that must be transmitted. To illustrate this point, consider a calculation of the number of bits necessary in the case of the CELP stochastic codebooks. If there are N samples per speech subframe such that N is a power of 2 (i.e. $N=2^M$), then each pulse in a Single Pulse Codebook (SPC) can occupy a total of N positions and, therefore, M bits must be transmitted to represent this pulse position uniquely. Thus, an SPC requires approximately M bits to encode the pulse position. Each additional SPC codebook will, therefore, require an increase in the transmission rate of M bits and this can form up to one-third of the total bit rate of the speech coder.

The approach preferred in relation to the present invention to deal with these conflicting requirements of increasing the number of codebooks while keeping the bit rate down is to use a special codebook formulation. If, instead of adding another SPC over the same subframe duration as the existing codebook, a set of 2 subframes can be taken together as a single unit (i.e. a Bi-Subframe). The new codebook must position a single pulse within the bi-subframe of 2N samples. This task will require only (M+1) bits compared to the single subframe analysis which would require M+M or 2M bits. In this way, an extra codebook can be added with a smaller increase in the total number of bits required.

In implementing the bi-subframe technique, a single pulse codebook (SPC) is referenced. A single pulse codebook is made up of vectors that are zero in every sample except one which has a +1 value. This codebook is not only similar in form to the bi-pulse codebook but also in its computational details. If the +1 value occurs in row k of the codeword c, the values $C_i$, $G_i$ are now computed as:

$$C_i=d_k$$

$$G_i=F_{kk} \tag{27}$$

In most other respects, this codebook is identical to the bi-pulse codebook so that the concepts of a truncated impulse response for the codebook search and a numerator-only search can be utilized.

Figure 6:
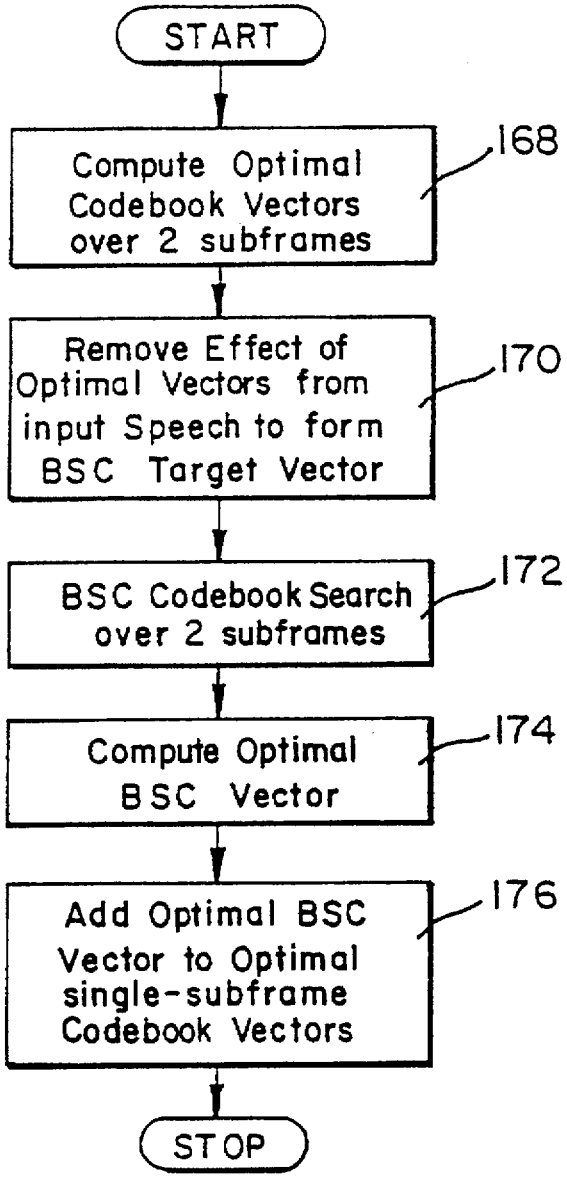
FIG. 6 is a flow chart of a bi-subframe codebook search technique in accordance with the present invention.

Consider now the details of the operation of the bi-subframe codebook (BSC) search in relation to FIG. 6. For the two subframes under consideration, the initial codebook searches, i.e. LTP-CB1 and CB0-CB1, are carried out at 168 as described previously to produce a set of 2 winning codevectors for each subframe. At 170, the effect of these codevectors is removed from the input speech signal corresponding to both the subframes to produce the target vector of length 2N for the BSC search. A codebook search, similar to that performed in relation to FIGS. 3 and 4, is performed at 172 and 174 except that the codevector is a single pulse codevector. The winning BSC codevector is itself 2N samples long. At 176, the optimal BSC vector is computed by adding the first half of the BSC vector to the winning codevectors from the 1st subframe while the rest of the BSC vector is added to the winning codevectors from the 2nd subframe to produce the necessary vectors used as an input to the LPC synthesis filter which outputs the synthesized speech.

In the preferred CELP coder, this BSC is actually a scrambled Hadamard codebook (i.e. a single pulse vector is passed through a Hadamard Transform and a scrambling operation before producing the codevector) and the codevectors are, therefore, constituted of samples with values +1, −1. This random noise component is used to augment the effect of the LTP-CB1 or CB0-CB1 codebook combinations. As the preferred embodiment employs 5 subframes within each frame, the BSC structure used is such that one BSC codebook operates on the 1st two subframes, another operates on the next 2 subframes and no BSC is used on the last subframe.

The net effect of this entire methodology is that 3 codebooks are now operating concurrently and one actually changes from an adaptive to a stochastic codebook and vice versa based on the nature of the input signal. In addition, both CB0 and CB1 are themselves adaptive in the sense that they either produce an SHC or a BPC codevector. These properties produce a very powerful coding architecture at a reasonable coder bit rate. The only factor that has been sacrificed to some extent is an increase in the processing power required to implement the coder as both the innovations necessitate a greater amount of computation.

A common property of both the SHC and BPC codebooks is that the codevectors within these codebooks are spectrally flat, i.e. their frequency response is, on the average, constant across the entire frequency band. This is usually a necessary property as this flat frequency response is shaped by the LPC synthesis filter to match the correct speech frequency spectrum.

However, for much of the speech transmitted in both landline and mobile telephony, the input speech is filtered to a frequency range of 300–3400 Hz. This is in spite of the fact that the signal sampling frequency is 8000 Hz, i.e. it is assumed that the signal contains frequencies in the range 0–4000 Hz. Therefore, the frequency spectrum of the filtered speech contains very little energy in the region 3400–4000 Hz. However, an important property of the LPC synthesis filter is that it matches the speech frequency response extremely well at the peaks in the response and not as well in the valleys. Therefore, the synthesis filter response does contain some energy in this range and so the codebook vector—when passed through this synthesis filter—also contains energy within the 3400–4000 Hz band and does not form a good match to the input speech within this range. This situation is exacerbated by the LTP since it introduces a pitch-correlated periodic component to this energy and results in high frequency buzz and/or a nasal effect to many voiced sounds.

One way to alleviate this problem is to filter the codebook vectors through a low pass filter such that they also contain very little energy at high frequencies. However, it is very difficult to produce a filter which sharply cuts off the correct frequencies effectively without incurring a considerable computational expense. Also, if a less sharp filter is used instead, this results in a low-pass muffled effect in the output speech.

Figure 7A:
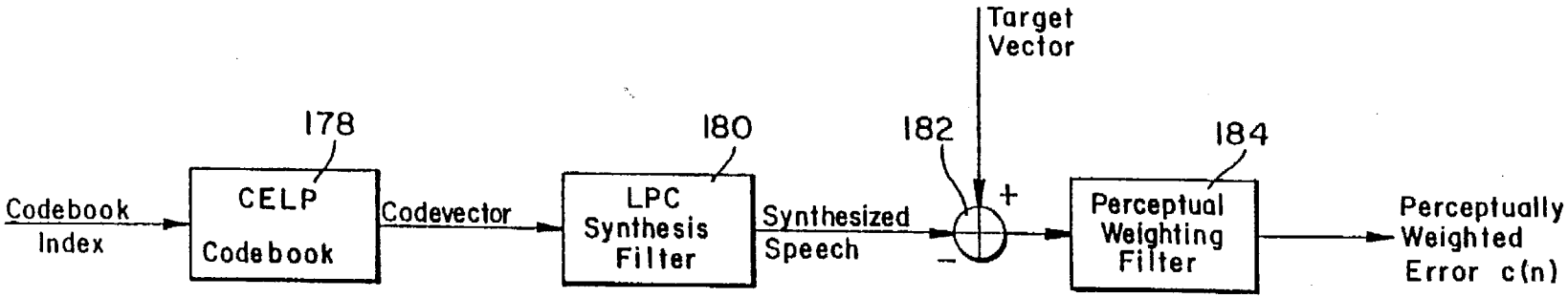
FIG. 7(*a*) is a block diagram of an embodiment of a perceptual weighting filter implemented in the adaptive transform coder shown in FIG. 2.
Figure 7B:
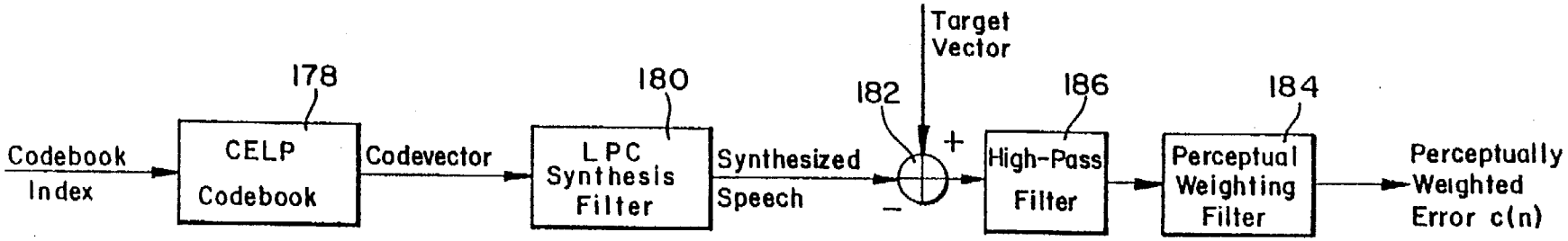

The approach used in the present invention does not directly filter the codebook vectors but rather introduces some modifications to what is known as the Perceptual Weighting Filter (PWF). This filter is shown in FIG. 7(*a*) to filter the error signal formed by subtracting the synthesized speech signal for a particular set of codevectors from the input speech. In order to understand the operation of the PWF consider that codebook 178 is indexed to output codevectors to synthesis filter 180. The synthesized speech output from synthesizer 180 is subtracted from the target vector at 182. If the synthesized speech exactly reproduced the target vector, the output of 182 would have zero energy at all frequencies, i.e., e(n) would equal zero. The output at 182 is passed through PWF 184.

As its name suggests, the purpose of the PWF is to weight those frequency components in the error signal e(n) which are perceptually most significant. This is important since the energy in the signal e(n) determines which codevector is selected during a particular codebook search, i.e. the winning codevector is the one which produces the smallest e(n) signal and therefore, the codebook search has this perceptual weighting built into it. It is important to note that the codevector is not itself passed through the PWF during the synthesis process, it is only during the codebook search procedure that the PWF is included to select the most appropriate codevector.

In the case of the codevectors which produce significant energy in the 3400–4000Hz range, it is desirable to improve the match between the input frequency response and the synthesized speech response within this band. In order to do this, certain frequencies need to be made more perceptually important by increasing their significance in the signal e(n). An easy way to do this is to modify the PWF such that these high frequencies are raised relative to the rest of the frequency band—which implies that a high-pass filter must be added in conjunction with the existing PWF. This situation is illustrated in FIG. 7(*b*), wherein a high pass filter 186 has been added to the process. However, as the PWF must be used to filter signals at the heart of the codebook search, it is imperative that the form of the new high-pass filter (HPF) be as simple as possible so the net effect of the PWF+HPF can be achieved as efficiently as possible.

The details of this HPF are now described in reference to the standard PWF. If the input to a conventional PWF is x(n) and the output signal is y(n), then the filtering operation can be represented as:

$$y(n) = x(n) + \sum_{i=1}^{10} pwfn_i x(n-i) + \sum_{i=1}^{10} pwfd_i y(n-1) \quad (3)$$

where pwfn, pwfd, are the coefficients of the PWF. A means of adding a simple HPF known as a first-order high-pass filter is by modifying the coefficients pwfd, to yield a new set of coefficients pwfd, such that:

$$pwfd'_i = pwfd_i + c \cdot pwfd_{i-1}$$

for i=2, 3, 4, . . . , 10 with the special case:

$$pwfd'_1 = pwfd_1 - c$$

for i=1

These new coefficients are then used in place of pwfd, in equation (1) above. The preferred value of a c is 0.4. This very simple modification then has the desired effect of increasing the importance of high frequency regions within the codebook search procedure and thereby produces a codevector which matches the speech signal within the critical 3400–4000Hz frequency band much more closely without actually low-pass filtering the codevector itself.

Considering briefly, reception of a signal generated in accordance with the present invention, attention is again directed to FIG. 1(*b*). Transmitted telecommunication signals appearing on bus 18 (FIG. 2) are first buffered at 28 in order to assure that all of the bits associated with a single frame are operated upon relatively simultaneously. The buffered signals are thereafter de-formatted at 30. LPC information is provided to synthesis filter 38. LTP information is provided to the periodic excitation generator or the adaptive codebook vector former 32. The i and j information together with the identification of the particular search method chosen at 134, 162 and 174, are provided to codevector construction generators 34. The output of generator 32 and 34 are added at 36 and provided to synthesis filter 38 as the excitation signal.

It will be recalled that a different codevector c is generated for each of the codebook search techniques. Consequently, the identification of the codebook search technique used allows for the proper codevector construction. For example, if the bi-pulse search was used, the codevector will be a bi-pulse having a +1 at the i row and a −1 at the j row. If the scrambled search technique is used, since the pulse positions are known the codevector c for the SHC can be readily formed. This vector is then transformed and scrambled. If the single pulse method was used, the codevector c is still capable of quick construction.

While the invention has been described and illustrated with reference to specific embodiments, those skilled in the art will recognize that modification and variations may be made without departing from the principles of the invention as described herein above and set forth in the following claims.

What is claimed is:

1. Apparatus for determining codevectors in a speech coder which codes a speech signal for digital transmission, which speech coder generates a target vector, said apparatus comprising a computer storage medium, said computer storage medium comprising:

first codebook means for determining characteristics of a bi-pulse codevector representative of said target vector and for removing said bi-pulse codevector from said target vector thereby forming an intermediate target vector; and second codebook means for determining characteristics of a second bi-pulse codevector in response to said intermediate target vector.

2. The apparatus of claim 1, wherein said first codebook means comprises a first stochastic codebook means for determining a first stochastic codeword in relation to said target vector.

3. The apparatus of claim 1, wherein said second codebook means comprises a second stochastic codebook means for determining a second stochastic codeword in response to said intermediate target vector.

4. The apparatus of claim 3, wherein said first and second codebook means each comprise a scrambled Hadamard codebook search means for determining a scrambled Hadamard codeword and a bi-pulse codebook search means for determining the characteristics of a bi-pulse codeword.

5. The apparatus of claim 1, wherein said speech coder further comprises:

third codebook means for adaptively determining a first codeword in response to said target vector and for removing said codeword from said target vector thereby forming an intermediate target signal; and fourth codebook means for stochastically determining a second codeword in response to said intermediate target signal.

6. The apparatus of claim 5, wherein said third codebook means comprises adaptive codebook means determines long term predictor information in relation to said target vector.

7. The apparatus of claim 5, wherein a first synthesized speech signal can be determined from said first and second codevectors and wherein a second synthesized speech signal can be determined from said first and second codewords, said apparatus further comprising error calculation means for calculating the error associated with said first and second speech signals and a comparator for comparing the error associated with said first and second speech signals and for selecting the speech signal having the lowest error.

8. The apparatus of claim 7, further comprising scaling means for scaling the error associated with said first speech signal prior to comparison by said comparator.

9. A speech coder for converting an analog speech signal to a digital speech signal for transmission, wherein said analog speech signal is converted into a series of digital speech samples and wherein said speech samples are divided into frames, each frame containing a number of speech samples, said speech coder comprising:

first search means for performing an adaptive codebook search and a first stochastic codebook search for each of said frames in response to said speech signal and for forming an adaptive codevector and a first stochastic codevector;

second search means for performing a second stochastic codebook search and a third stochastic codebook search for each of said frames in response to said speech signal and for forming a second stochastic codevector and a third stochastic codevector;

error means for computing a first difference value between said adaptive and first stochastic codevectors and said speech signal and for determining a second difference value between said second and third stochastic codevectors and said speech signal; and a comparator comparing said first and second difference values to determine which is less and for choosing the codevectors associated with the difference value determined to be lowest.

10. The speech coder of claim 9, wherein each of said frames is divided into a plurality of subframes, wherein said first and second search means determine said adaptive, first, second and third stochastic codewords for each subframe and wherein said comparator determines which of said first and second difference values is lowest for each of said subframes.

11. The speech coder of claim 10, wherein said comparator determines which of said first and second difference values is lowest for a plurality of said subframes.

12. The speech coder of claim 11, wherein said error means comprises an accumulator for accumulating said first and second difference values over a plurality of frames.

13. The speech coder of claim 12, wherein said accumulator comprises a first adder for adding a plurality of said first difference values and a second adder for adding a plurality of said second difference values.

14. The speech coder of claim 13, wherein said accumulator accumulates the first and second error values associated with two subframes.

15. The apparatus of claim 14, further comprising scaling means for scaling the value associated with said second difference value accumulated by said accumulator.

16. The speech coder of claim 10, further comprising:

removal means for removing either said adaptive and first stochastic codewords or said second and third stochastic codewords associated with said first or second difference values chosen by said comparator from said speech signal thereby forming a remainder target signal; and third search means for performing a codebook search on said third remainder target signal.

17. The speech coder of claim 16, wherein said third search means performs a stochastic codebook search over two remainder target signals associated with two subframes.

18. The speech coder of claim 16, wherein said third search means comprises apparatus for performing a single pulse codebook search.

19. The speech coder of claim 9, wherein said first search means removes said adaptive and first stochastic codevectors from the corresponding portion of said speech signal thereby forming a first remainder signal and wherein said second search means removes said second and third stochastic codevectors from the corresponding portion of said speech signal, thereby forming a second remainder signal, said speech coder further comprising a weighting filter, interposed between said first and second search means and said error means for weighting predetermined portions of said first and second remainder signals prior to the determination of said first and second difference values.

20. The speech coder of claim 19, wherein said weighting filter means weights the frequencies of said remainder signal greater than 3,400 Hz.

21. The speech coder of claim 19, further comprising a high pass filter interposed between said first and second codebook search means and said weighting filter means.

* * * * *